US005788822A

United States Patent [19]

Martyak et al.

[11] Patent Number: 5,788,822

[45] Date of Patent: Aug. 4, 1998

[54] HIGH CURRENT DENSITY SEMI-BRIGHT AND BRIGHT ZINC SULFUR-ACID SALT ELECTROGALVANIZING PROCESS AND COMPOSITION

[75] Inventors: Nicholas M. Martyak, Doylestown, Pa.; Marie M. Kasper, Redbank, N.J.

[73] Assignee: Elf Atochem North America, Inc., Philadelphia, Pa.

[21] Appl. No.: 854,316

[22] Filed: May 12, 1997

Related U.S. Application Data

[60] Provisional application No. 60/017,778, May 15, 1996.

[51] Int. Cl.[6] ..... C25D 3/22

[52] U.S. Cl. ..... 205/313; 205/314; 205/244

[58] Field of Search ..... 205/313, 314, 205/244

[56] References Cited

U.S. PATENT DOCUMENTS 4,229,268 10/1980 Lowery et al. ..... 205/313

5,718,818 2/1998 Martyak et al. ..... 205/313

*Primary Examiner*—Kathryn Gorgos

*Assistant Examiner*—Kishor Mayekar

*Attorney, Agent, or Firm*—Stanley A. Marcus; Gilbert W. Rudman

[57] ABSTRACT

The inventors disclose a process for producing semi-bright to bright electrogalvanic coatings at high current densities, comprising electroplating a cathodic conductive substrate in a coating bath based on:

a) a zinc sulfur-acid salt;

b) a low molecular weight polyoxyalkylene glycol based on 2 to about 4 carbon atom alkylene oxides;

c) an aromatic sulfonate; and d) a conductivity enhancing salt.

The process includes maintaining the coating composition at a pH from about 2 to about 5 and the current density on the substrate at from about 1,000 to about 3,700 ASF. The zinc sulfur-acid salt includes zinc sulfate or a zinc organosulfonate, and the conductivity enhancing salt, a potassium salt. In one embodiment, the aromatic sulfonate comprises a condensation product of an aromatic sulfonate and formaldehyde. The inventors also describes coating bath compositions.

13 Claims, No Drawings

HIGH CURRENT DENSITY SEMI-BRIGHT AND BRIGHT ZINC SULFUR-ACID SALT ELECTROGALVANIZING PROCESS AND COMPOSITION

TECHNICAL FIELD

This application claims the benefit of U.S. Provisional Application No. 60/017,778, filed May 15, 1996.

The field of the invention comprises a composition of matter for high current density semi-bright and bright zinc electrogalvanizing baths and processes utilizing such composition.

BACKGROUND ART

The tubular steel, wire, sheet metal and automotive industries provide corrosion resistance to steel substrates by continuous or batch plating steel with zinc in an electrogalvanic coating bath. They employ acid chloride and sulfate baths extensively because this allows higher plating speeds than cyanide coating baths. These baths have also displaced cyanide baths because of EPA regulations requiring the reduction or elimination of cyanide in effluents. Typical plating tanks employed in these processes contain anywhere from about 50,000 to about 300,000 gallons of coating solution and will accommodate tubular steel, wire, or steel rolls. Processing speeds for continuous electrogalvanization reach anywhere from about 200 to about 850 feet per minute. High speed continuous or batch coating, however, requires high current densities (HCD), e.g., 1,000–3,700 ASF (amps per square foot) for semi-bright or bright zinc coatings, which can contribute to dendrite build up and other imperfections in the coating.

Nonetheless, HCD processes provide a way to increase production speed and thereby improve the economy of the operation.

The ASTM specification for zinc deposits on ferrous metals calls for thicknesses of from about 5 to about 25 μm, depending on the severity of the expected service. ASTMB633-78, Specification For Electrodeposited Coatings Of Zinc On Iron and Steel.

Plating tanks employed in the steel industry to produce galvanized steel tubing for electrical conduit vary from about 100 gallons to about 50,0000 gallons and employ current densities from about 10 to about 75 A/dm$^2$. Solution agitation occurs as a result of passing the substrate through the bath at a rate of from about 0.1 to 1 m/sec, which is less than that employed in the automotive industry. Deposit thickness varies from about 0.2 to about 20 μm.

Zinc is deposited from aqueous solutions by virtue of a high hydrogen over voltage since hydrogen preferentially deposits under equilibrium conditions.

Zinc chloride electrolyte plating baths commonly employ soluble anodes in the system. Zinc sulfate electrolyte solutions generally operate at a pH of about 1.2 to about 3 and elevated temperatures anywhere from about 35° C. to about 80° C. The low pH generally requires employing insoluble anodes; however, some zinc sulfate solutions may employ zinc anodes.

Conventional bright zinc electrogalvanizing processes employ zinc chloride solutions with various additives at a pH of from about 4.8 to about 5, temperatures of about 20° C. (room temperature) and current densities at from about 30 to about 40 ASF. Making up the bath with sulfuric acid, i.e., using a zinc sulfate salt does not allow operating at higher current densities since the additives used in $ZnCl_2$ baths do not work in the sulfuric acid systems. Additionally, this leads to the production of dull rather than bright zinc deposits, but in any event suitable current densities for electrogalvanizing remain low.

Wire plating proceeds in substantially the same way at from about 10 to about 100 A/dm$^2$, with mild solution agitation where the wire is unspooled at one end of the line, cleaned, plated, and spooled at the other end. Line speeds vary in order to obtain different critical deposit thicknesses which vary from about 10 to 100 μm.

The industry electrogalvanizes steel tubes (sometimes referred to as "steel conduit") for use in electrical circuits in house, apartment building, office and factory wiring to prevent corrosion of the steel substrate.

The coating forms on the outer wall of the tube with the inner surfaces remaining free of the electrogalvanic coating. The tubes generally range in size up to 10 feet in length and inner diameters of ½ inch up to about 3 or 4 inches. During the electrogalvanizing process, however, the coating bath, which is acidic, attacks the inside of the tube and causes iron to dissolve in the solution.

Typical electrogalvanizing solutions used in this method comprise zinc sulfate (about 300 grams/liter), potassium chloride (about 50 grams/liter), and various art known additives. Operating the baths with these additives at a pH of about 1.5 to about 2 and a current density from about 30–40 ASF produces a semi-bright deposit. Steel conduit plated in this way encounters problems in addition to the dissolution of iron from the inner surface of the conduit into the coating solution, such as marginal and variable corrosion resistance.

The industry determines corrosion resistance by placing a single drop of 5% lead acetate on the zinc plated tube. The time required for the drop of lead acetate to turn black or darken gives the industry accepted value for corrosion resistance which varies from about 20 to about 30 seconds.

Although wiring and building codes require prescribed levels of corrosion resistance, lack of adequate corrosion resistance presents a problem during the transportation of steel conduit in winter months in northern areas which rely on salt for ice removal from roads. Exposure to salt spray of steel conduit shipped on open bed trucks under these conditions can cause costly corrosion.

In addition to problems with corrosion resistance and iron dissolution from the inside of steel conduit during electrogalvanizing, other problems occur in high current density semi-bright and bright zinc sulfate electrogalvanizing processes and compositions. Many of the organic additives to the bath come out of solution at a low pH (e.g., about pH 1.5) and low current densities ordinarily employed for semi-bright and bright electrogalvanizing compositions slow down production thereby reducing coating economies.

Consumer acceptance or saleability of steel conduit or other steel substrates depends to some degree on the brightness of the coating. Brighter coatings have more sales appeal than dull coatings. It would therefore be an advantage to obtain coatings which did not have a dull or lackluster appearance.

Canaris, U.S. Pat. No. 5,200,057 describes acid zinc and zinc-alloy plating baths and methods for electrodepositing zinc and zinc alloys based on a polyvinyl pyrrolidone and a sulfur-containing adduct of an ethylene or propylene glycol. The bath also includes a nonionic ethoxylated surfactant and a polycondensation product of an aromatic sulfonic acid and formaldehyde. Although zinc chloride and zinc sulfate baths are described, the preferred bath contains chloride ions, but no sulfate ions. Electrodeposition is described at current densities up to 125 ASF.

Canaris, U.S. Pat. No. 4,832,802 describes acid zinc-nickel plating baths and methods for electrodepositing bright zinc-nickel alloys employing a polymeric sulfur compound based on the condensation products of either ethylene or propylene oxide. The bath composition also includes aromatic sulfonic acids or condensation products of these acids with formaldehyde and nonionic ethylene oxide condensate surfactants. The composition also includes either a zinc sulfate or zinc organosulfonate salt. The reference discloses only low current densities employed in the process, i.e. current densities ranging from below 0.3 amps/dm$^2$ to above 12 amps/dm$^2$ (i.e. 2.78 to 111.3 ASF).

Rosenberg, U.S. Pat. No. 4,251,331 describes an alpha-amino aliphatic carboxylic acid in combination with a nonionic surface active compound and a carbonyl compound as a brightening agent for electroplating bright zinc in order to eliminate ammonium chloride as a bath constituent. The bath also contains zinc sulfate, and a condensation product of sulfonated naphthalenes with formaldehyde. Although described as a bath suitable for high current density plating, the patentee does not specify current densities.

Lowery et al., U.S. Pat. No. 4,229,268 discloses acid zinc plating baths and methods for electrodepositing bright zinc deposits employing a polymeric sulfur-containing composition based on ethylene or propylene oxide condensates, zinc sulfate, aromatic sulfonic acids or condensation products of these acids with formaldehyde and a nonionic ethylene oxide condensate surfactant. The patentees describe the coating composition as producing bright zinc coatings over a current density range of from below 0.3 amps/dm$^2$ to above 12 amps/dm$^2$ (i.e. 2.78 to 111.3 ASF).

Broadwell, U.S. Pat. No. 905,837 describes the electrodeposition of zinc and alloys containing aluminum or cadmium or like metals having a brightening influence upon zinc. The process utilizes a solution of zinc sulfate in combination with zinc naphthalene di-sulfonate. The alloy is electrodeposited by incorporating a salt of the alloying metal such as aluminum sulfate into the electroplating bath.

Flett, U.S. Pat. No. 2,195,409 describes the use of an alkyl aromatic sulfonic acid in a zinc plating bath containing zinc sulfate and aluminum sulfate.

Creutz, U.S. Pat. No. 4,207,150 describes a non-cyanide zinc electroplating bath based on zinc chloride, sulfate, fluoroborate or acetate with levelling amounts of methane sulfonic acid (sometimes referred to as "MSA") zinc salts in amounts from about 0.005 to 5.0g/l. The coating bath is operated in a pH range of 2.0 to 7.5 and also contains so-called secondary or supporting brighteners consisting of polyethers having a molecular weight from 100 to 1,000,000. Plating is carried out at from 60° F. to 140° F. at current densities ranging from 5 ASF, to 200 ASF and in a pH range from 2.0 to 7.5.

Wilson, U.S. Pat. No. 5,039,576, describes the use of alkyl sulfonic or polysulfonic acids or salts in combination with a tin and bismuth ion for the electrodeposition of tin-bismuth alloys on a conductive substrate.

U.S. Pat. No. 774,049 describes a process for electrolytically depositing lead peroxide on lead plates from baths containing a sulfonic acid or oxysulfonic acid derivative of methane and its hydroxy-substituted derivatives. These include methylsulfonic acid, methylene disulfonic acid, oxymethylene disulfonic acid and the like.

U.S. Pat. No. 2,313,371 and British Patent No. 555,929 describe tin and tin-lead plating baths containing aromatic sulfones and mono- and poly-sulfonic acids of benzene, phenol and cresol.

U.S. Pat. No. 4,132,610 discloses tin-lead alloy plating baths containing hydroxyalkyl sulfonic acids.

Deresh et al, U.S. Pat. No. 4,849,059 describes a tin, lead, or tin-lead alloy electroplating bath containing free alkane sulfonic acid brightening agents and other compounds.

Pilavov, Russian Patent 1,606,539 describes weak acidic baths for electrogalvanizing steel containing a condensation copolymer of formaldehyde and 1,5- and 1,$^8$-amninonaphthylalene-sulfonic acid prepared in monoethanolamine. The galvanized steel shows a smaller decrease in ductility compared to that obtained from a conventional bath.

Arcilesi, U.S. Pat. No. 4,137,133 discloses an acid zinc electroplating process and composition containing as cooperating additives, at least one bath-soluble substituted or unsubstituted polyether, at least one aliphatic unsaturated acid containing an aromatic or heteroaromatic group and at least one aromatic or N-heteroaromatic aldehyde.

DISCLOSURE OF THE INVENTION

Accordingly, the present invention seeks to obtain the advantage of avoiding these and other difficulties encountered in the related art.

These and other advantages are obtained according to the present invention which is the provision of a process and composition of matter that substantially obviates one or more of the limitations and disadvantages of the described prior processes and compositions of matter of the related art.

The description which follows sets forth additional features and advantages of the invention, and in part, will become apparent from the description or learned by practice of the invention. The skilled artisan will realize the objectives and other advantages of the invention obtained by the process and composition of matter particularly pointed out in the written description and claims hereof.

To achieve these and other advantages, and in accordance with the purpose of the invention, as embodied and broadly described, the invention comprises a high current density semi-bright and bright electrogalvanizing process and a composition of matter which allows electrogalvanizing at higher current densities to obtain faster coating rates, higher corrosion resistance, less dissolution of iron in the coating solution and a zinc coating slightly brighter than prior art coatings.

The coatings produced according to the invention also do not vary in corrosion resistance to the degree that present coatings do.

In one embodiment, the process of the present invention comprises producing a semi-bright to bright electrogalvanic coating at high current densities to obtain the foregoing advantages by electroplating a cathodic conductive substrate in a coating bath having an anode therein, the composition of the bath comprising:

a) a zinc sulfur-acid salt;

b) a low molecular weight polyoxyalkylene glycol based on 2 to about 4 carbon atom alkylene oxides;

c) an aromatic sulfonate; and d) a conductivity enhancing salt;

Maintaining the coating composition at a pH from about 2 to about 5 minimizes or substantially minimizes the dissolution of the substrate, and especially iron-based substrates in the coating solution. Additionally, operating at this pH range minimizes or eliminates separation of the organic coating additives from the coating composition when dissolved in water.

Corrosion resistance of the substrate after applying the coating increases substantially compared to known processes and compositions, with a substantial minimization or elimination of the variation in corrosion resistance when employing the process of the invention.

Lastly, the plating process proceeds at a current density on substrate at from about 1,000 to about 3,700 ASF. Maintaining these higher current densities, compared to prior art processes, allows for faster production speeds with a resultant improvement in coating economies.

The invention also comprises compositions of matter comprising the foregoing zinc sulfur-acid salt, organic surfactant, aromatic sulfonate and conductivity enhancer.

The process and composition of the invention provide excellent bright and semi-bright zinc coatings on steel conduit, steel wire, and sheet steel.

BEST MODE FOR CARRYING OUT THE INVENTION

The zinc sulfur-acid salt electrogalvanic coating baths of the present invention generally comprise a mixture of anywhere from about 120 to about 200 grams/liter, and especially from about 140 to 180 grams/liter, of a zinc sulfur-acid salt.

In addition to zinc sulfate, the process and composition of the invention can employ zinc salts of any one of the sulfur acids noted herein including zinc organosulfonates, or mixtures thereof, as well as mixtures with zinc sulfate such as the two component or three component mixtures.

The coating composition of matter also includes a low molecular weight polyoxyalkylene glycol based on 2 to about 4 carbon atom alkylene oxides, which may comprise a homopolymer or copolymer having a molecular weight of from about 570 to about 630, and especially one having an average molecular weight of about 600. Homopolymers or copolymers based on ethylene oxide are preferred, especially homopolymers based on ethylene oxide.

The invention can also utilizes low molecular weight polyoxyalkylene glycols based on 3 to about 4 carbon atom alkylene oxides, and includes the homopolymers or copolymers thereof with each other and/or ethylene oxide. The low molecular weight polyoxyalkylene glycol is one that has a molecular weight from about 300 to about 1,100 and especially from about 325 to about 800 and preferably from about 350 to about 550. Those having an average molecular weight of about 425 are especially useful. Homopolymers and copolymers based on propylene oxide are preferred, especially homopolymers based on propylene oxide, such as for example, polypropylene glycol 425.

The copolymers may be random or block copolymers, where the repeating units of the block copolymers are block or heteric or the various combinations of these repeating units known in the art.

The molecular weight or average molecular weight of the glycols as those terms are employed herein refers to the weight average molecular weight.

The amount of glycol employed varies from about 0.7 to about 7 gms/liter, especially from about 0.9 to about 6 gms/liter, and preferably from about 1 to about 5 gms/liter.

The composition also includes an aromatic sulfonate, e.g., a sulfonated condensation product of an aromatic sulfonate such as naphthalene sulfonate and formaldehyde, or other lower molecular weight aldehydes, such as acetaldehyde, butyraldehyde and the like, described for example by Todt et al., U.S. Pat. No. 3,878,069, incorporated herein by reference.

The aromatic group of either compound may be any six membered ring or polynuclear ring having from about 10 to about 14 carbon atoms, all of which are well known in the art. Anywhere from one to about three sulfonate groups can be substituted on the aromatic ring. Lowery et al., U.S. Pat. No. 4,229,268, also incorporated herein by reference, further describes compounds of the foregoing types of aromatic sulfonates that are not condensation products with low molecular weight aldehydes.

GAF sells a condensation product of naphthalene sulfonate and formaldehyde under the trade name BLANCOL®-N, BASF under the trade name TAMOL® NNO, Kokko Corporation under the trade name DEMOL® N, and Stepan Chemical Company under the trade name STEPANTAN® 1 any of which can be used in accord with the present invention.

The aromatic sulfonate in the composition varies with the glycol in a range of glycol to aromatic sulfonate anywhere from about 2.4 to about 1.2, especially from about 2.2 to about 1.1, and preferably from about 2 to about 1.

The composition also has a salt-type conductivity enhancer in an amount sufficient to increase the conductivity of the coating composition. Conductivity enhancers include, by way of example, alkali metal salts such as any alkali metal salt based on the Group IA or IIA metals taken from the Periodic Table of the Elements, and especially lithium, sodium, potassium, magnesium, calcium, strontium and barium salts, especially the sulfur acid salts (as sulfur acids are defined herein) or the halides (i.e., the fluorides, chlorides, bromides and iodides), especially the fluorides or chlorides and preferably the chlorides. These salts also include mixtures thereof, especially the two component and three component mixtures. Potassium salts comprise the preferred salts.

Halides of alkali metals, both as defined herein, especially the potassium halides, also comprise a preferred class of salts.

Although the skilled artisan can readily determine the amount of the conductivity enhancing salt employed, generally the coating baths contains anywhere from about 1 to about 200 grams/liter and especially from about 10 to about 100 grams/liter of this compound.

Electrogalvanization according to the process takes place at a pH from about 2 to about 5 and especially about 2.5 to about 4.5, and especially about pH 3.

The inventors discovered that operating the bath at a pH from about 2 to about 5 and especially a pH greater than about 2 up to about 5 promotes the dissolution of the various organic additives to the coating bath and also substantially minimizes or substantially eliminates the dissolution of the metallic substrate in the coating bath especially iron-based substrates such as steel substrates in the bath. This reduction or substantial elimination of dissolved metal and especially dissolved iron in the bath amounts to a reduction of the corrosion of the inner surface of steel conduit and importantly, also substantially eliminates or reduces deposition of zinc alloy and especially zinc-iron alloy coatings on the substrate, which in some instances provides a benefit to the coating.

Importantly, the process and composition allow use of higher current densities to apply the coating as compared to prior art processes for conventional semi-bright and bright zinc plating baths which could employ current densities no greater than from about 30 to about 40 ASF. The current process and composition allow conducting the coating operating at current densities anywhere from about 1,000 ASF to about 3700 500 ASF, and especially from about 1,200 to about 2,700 ASF.

The process of the invention proceeds at temperatures from about room temperature (20° C.) to about 50° C., and especially from about 25° C. to about 45° C. preferably from about 30° C. to about 40° C.

Electrogalvanizing proceeds in the manner described herein by electrolytically coating a conductive substrate with the composition of the invention, where the substrate comprises any electrically conductive substrate whether a metal substrate, or insulating substrate (e.g., a polymeric material, such as a synthetic polymeric substrate, or a ceramic substrate) coated with a conductive material such as a metal or any art known conductive substrates such as a carbon substrate. Coating proceeds by passing a current between a zinc anode or insoluble anode known in the art in the electrogalvanic coating bath to the cathode substrate in the bath for a period of time sufficient to deposit a zinc coating on the cathode.

The polyoxyalkylene glycols of the present invention are preferably water soluble at operating temperatures and may be polyoxyalkylene glycol ether all-block, block-heteric, heteric-block or heteric-heteric block copolymers where as noted, the alkylene units have from 2 to about 4 carbon atoms and may comprise surfactants which contain hydrophobic and hydrophilic blocks where each block is based on at least oxyethylene groups or oxypropylene groups or mixtures of these groups. Mixtures of homopolymers and copolymers may also be used, especially the 2 or 3 component mixtures.

Of the various polyether-polyol block-copolymers available, the preferred materials comprise polyoxyalkylene glycol ethers which in the case of surfactants contain hydrophobic and hydrophilic blocks, each block preferably containing at least oxyethylene groups or oxypropylene groups or mixtures of these groups.

The most common method of obtaining these materials is by reacting an alkylene oxide such as ethylene oxide with a material that contains at least one reactive hydrogen. Alternative routes include the reaction of the active hydrogen material with a preformed polyglycol or the use of ethylene chlorohydrin instead of an alkylene oxide.

The reacting active hydrogen material must contain at least one active hydrogen preferably alcohols, and optionally acids, amides, mercaptans, alkyl phenols and the like. Primary amines can be used as well.

Especially preferred materials are those obtained by block polymerization techniques. By the careful control of monomer feed and reaction conditions, a series of compounds, e.g., surfactants can be prepared in which such characteristics as the hydrophile-lipophile balance (HLB), wetting and foaming power can be closely and reproducibly controlled. The chemical nature of the initial component employed in the formation of the initial polymer block generally determines the classification of the materials. The initial component does not have to be hydrophobic. In the case of surfactants, hydrophobicity will be derived from one of the two polymer blocks. Typical starting materials or initial components include monohydric alcohols such as methanol, ethanol, propanol, butanol and the like as well as dihydric materials such as glycol, glycerol, higher polyols, ethylene diamine and the like.

The various classes of materials, suitable for practice of this aspect of the present invention that are surfactants, have been described by Schmolka in "Non-Ionic Surfactants," Surfactant Science Series Vol. 2, Schick, M. J., Ed. Marcel Dekker, Inc., New York, 1967, Chapter 10 which is incorporated herein by reference.

The first and simplest copolymer is that in which each block is homogeneous which is to say a single alkylene oxide is used in the monomer feed during each step in the preparation. These materials are referred to as all-block copolymers. The next classes are termed block-heteric and heteric-block, in which one portion of the molecule is composed of a single alkylene oxide while the other is a mixture of two or more such materials, one of which may be the same as that of the homogeneous block portion of the molecule. In the preparation of such materials, the hetero portion of the molecule will be totally random. The properties of these copolymers will be entirely distinct from those of the pure block copolymers. The other class is that in which both steps in the preparation of the different repeating units involve the addition of mixtures of alkylene oxides and is defined as a heteric-heteric block copolymer.

The block copolymer is typified by a monofunctional starting material such as a monohydric alcohol, acid, mercaptan, secondary amine or N-substituted amides. These materials can generally be illustrated by the following formula:

$$I-[A_m-B_n]_x \quad (1)$$

where I is the starting material molecule as described before. The A portion is a repeating unit comprising an alkylene oxide unit in which at least one hydrogen can be replaced by an alkyl group or an aryl group, and m is the degree of polymerization which is usually greater than about 6. The B moiety is the other repeating unit such as oxyethylene with n again being the degree of polymerization. The value of x is the functionality of I. Thus, where I is a monofunctional alcohol or amine, x is 1; where I is a polyfunctional starting material such as a diol (e.g., propylene glycol), x is 2 as is the case with the Pluronic® surfactants. Where I is a tetrafunctional starting material such as ethylenediamine, x will be 4 as is the case with Tetronic® surfactants. Preferred copolymers of this type are the polyoxypropylene-polyoxyethylene block copolymers.

Multifunctional starting materials may also be employed to prepare the homogeneous block copolymers.

In the block-heteric and heteric-block materials either A or B will be a mixture of oxides with the remaining block being a homogeneous block. Where the copolymer is a surfactant, one block will be the hydrophobe and the other the hydrophile and either of the two polymeric units will serve as the water solubilizing unit but the characteristics will differ depending on which is employed. Multifunctional starting materials can also be employed in materials of this type.

The heteric-heteric block copolymers are prepared essentially the same way as discussed previously with the major difference being that the monomer feed for the alkylene oxide in each step is composed of a mixture of two or more materials. The blocks will therefore be random copolymers of the monomer feed. In the case of surfactants, the solubility characteristics will be determined by the relative ratios of potentially water soluble and water insoluble materials.

The low molecular weight polyoxyalkylene glycol ether polymers or copolymers based on 2 to about 4 carbon atom alkylene oxides having a molecular weight from about 200 to about 800, especially from about 300 to about 700 and preferably from about 570 to about 630 utilized according to the present invention are those that may have weight ratios of A to B repeating units in formula (1) that vary from about 0.4:1 to about 2.5:1, especially from about 0.6:1 to about 1.8:1 and preferably from about 0.8:1 to about 1.2:1.

In one embodiment, these copolymers have the general formula:

$$RX(CH_2CH_2O)_nH \quad (2)$$

where R has an average molecular weight of from about 200 to about 60, especially from about 300 to about 500.

R in formula (2) is usually a typical surfactant hydrophobic group but may also be a polyether such as a polyoxyethylene group, a polyoxypropylene group, a polyoxybutylene group, or a mixture of these groups. In the above formula X is either oxygen or nitrogen or another functionality capable of linking the polyoxyethylene chain to R. In most cases, n, the average number of oxyethylene units in the oxyethylene group, must be greater than about 5 or about 6. This is especially the case where it is desired to impart sufficient water solubility to make the materials useful.

The average molecular weight of the polyoxyalkylene glycol ether block copolymers based on 3 to about 4 carbon atom alkylene oxides is from about 300 to about 1,000 and especially those having an average molecular weight of about 425. These copolymers, as represented by formula (1) are prepared so that the weight ratio of A to B repeating units will also vary from about 0.4:1 to about 2.5: 1, especially from about 0.6:1 to about 1.8:1 and preferably from about 0.8:1 to about 1.2:1. In one embodiment, these copolymers have the general formula:

$$RX(CH_2CH_2[CH_2]_yO)_nH \quad (3)$$

where R has an average molecular weight of from about 200 to about 900, especially from about 300 to about 850 and especially from about 350 to about 400.

R in formula (3) is usually a typical surfactant hydrophobic group but may also be a polyether such as a polyoxyethylene group, a polyoxypropylene group, or a polyoxybutylene group, or a mixture of polyoxypropylene, polyoxyethylene and polyoxypropylene groups. In the above formula (2) X is either oxygen or nitrogen or another functionality capable of linking the polyoxyalkylene chain to R, and y has a value of 0, 1, or 2. In most cases, n, the average number of alkylene oxide units must be greater than about 5 or about 6. This is especially the case where it is desired to impart sufficient water solubility to make the materials useful.

The preferred polyoxyalkylene glycol ethers are the non-ionic polyetherpolyol block-copolymers. However, other non-ionic block-copolymers useful in the invention can be modified block copolymers using the following as starting materials: (a) alcohols, (b) fatty acids, (c) alkylphenol derivatives, (d) glycerol and its derivatives, (e) fatty amines, (f)-1,4-sorbitan derivatives, (g) castor oil and derivatives, and (h) glycol derivatives.

The aniline compound used as a depolarizer in the composition of matter preferably comprises a mono or di-lower alkyl aniline where the lower alkyl group contains from 1 to about 4 carbon atoms and includes aliphatic alkyl groups as well as isomers thereof such as isopropyl or t-butyl, or i-butyl moieties, and the like. Dimethyl aniline is especially preferred.

Other aniline compounds that may be used including those that are mono or di-substituted at the amino position, are acetyl aniline, allylaniline, aminoaniline, aminodimethylaniline, benzalaniline, benzilideneaniline, benzoylaniline, benzylaniline, bianiline, bromoaniline, diacetylaniline, dibenzylaniline, dichloroaniline, dimethylaniline, dimethylaminoaniline, dinitroaniline, diphenylaniline, ethoxyaniline, ethylaniline, formylaniline, hydroxyaniline, iodoaniline, isopropylaniline, methenyltrianiline, methoxyaniline, N-methylaniline, nitrosoaniline, p-nitrosodiethylaniline, p-nitrosodimethylaniline, pentachloraniline, phenylaniline, propionylaniline, thioaniline, thionylaniline, tribromoaniline and trimethylaniline. Water-soluble aniline compounds are especially preferred.

The composition may also include a carbamate compound that may comprise a di-lower alkyl dithio carbamyl lower alkyl sulfonic acid where the lower alkyl groups contain from 1 to about 4 carbon atoms and include the aliphatic and branched chain aliphatic lower alkyl groups. A preferred carbamate comprises dimethyl dithio carbamyl propyl sulfonic acid (also referred to as N,N-dimethyl-dithiocarbamate-3-sulfopropyl ester sodium salt).

The foregoing composition may optionally contain an aldehyde in an amount anywhere from about 0.002 to about 0.006% by weight of the solution. Aliphatic saturated or unsaturated monoaldehydes or dialdehydes having from 1 to about 6 carbon atoms or an aromatic aldehyde having from 7 to about 15 carbon atoms can be used in this regard.

Formaldehyde is often used because of its ready availability. In addition to formaldehyde the aliphatic saturated aldehydes that may also be employed include acetaldehyde, propionaldehyde, butyraldehyde, valeraldehyde, and caproaldehyde.

Aliphatic unsaturated aldehydes may be used to include acrolein, crotonaldehyde, tiglicaldehyde, and propionaldehyde.

The various aliphatic dialdehydes that may be employed include glyoxal, succinaldehyde and adpialdehyde.

The various aromatic aldehydes that are useful according to the present invention include benzaldehyde, tolualdehyde, cinnamaldehyde, salicylaldehyde, anisaldehyde, naphthaldehyde and anthraldehyde.

Water-soluble aldehydes are especially preferred.

The composition may also include a water-soluble boron oxide compound such as boric acid or an alkali metal borate (where the alkali metals are defined herein) or a fluoroborate including the alkali metal fluoroborates, again where the alkali metals have been defined herein.

The water-soluble boron oxide compound is employed in an amount anywhere from about 10 to about 70 gms/liter and especially from about 30 to about 40 gms/liter of the coating bath.

In addition, the composition may also contain a lignin compound such as vanillin which is an aldehyde derived from lignin. Additionally, lignin sulfate or other lignin salts known in the art may be employed. These lignin compounds are brighteners and are used in those applications where a bright finish is desired.

The lignin compound may be employed in an amount anywhere from about 0.002 to about 0.01 gms/liter and especially from about 0.03 to about 0.05 gms/liter of the coating bath.

It is also within the scope of the invention to adjust the pH of the bath by the addition to it of sulfur acids such as sulfuric, sulfurous, oleum, thiosulfuric, dithianous, metasulfuric, dithionic, pyrosulfuric, or persulfuric acids and the like as well as mixtures thereof, and especially the two component or three component mixtures. Additionally, organo sulfonic acids including aromatic or aliphatic sulfonic acids, including alkane sulfonic acids of the formula $(R)(SO_3)_X$, where R and x are defined hereinafter, also fall within the class of sulfur acids used to adjust the pH.

When used, the zinc organosulfonate preferably comprises a water soluble compound by which it is meant that the compound is soluble in water at about room temperature (about 20° C.) or lower (about 10° C. to about 20° C.), and preferably from these temperatures up to or slightly below the operating temperature of the bath, and has the formula:

$$Zn[(R)(SO_3)_x]_y \quad (A)$$

where x has a value from 1 to about 3; and y has a value from 1 to 2 so that y may be 1 when x is greater than 1.

R is an organo group comprising an alkyl group having from 1 to about 15 carbon atoms and especially 1 to about 7 carbon atoms including the straight chain and branch chain isomers thereof such as methyl, ethyl, propyl, isopropyl, butyl, t-butyl, isobutyl, pentyl, isopentyl, and the like. Hydroxy substituted alkyls, as alkyl is defined herein, are also included. Specific zinc salts in this regard comprise zinc methane sulfonates, zinc ethane sulfonates, zinc propane sulfonates, zinc isopropane sulfonates, zinc butane sulfonates, zinc isobutane sulfonates, zinc t-butane sulfonates, zinc pentane sulfonates, zinc isopentane sulfonates, and the like, as well as the hydroxy substituted compounds thereof. R also includes cyclic, and heterocyclic hydrocarbon substituents such as cycloaliphatic, unsaturated cycloaliphatic, and aromatic groups having from 4 to about 16 carbon atoms and especially from about 6 to about 14 carbon atoms including cyclobutyl, cyclobutenyl, cyclohexyl, cyclohexenyl, cyclohexadienyl, cyclooctanyl, cyclooctadienyl, furanyl, furfuryl, pyranyl, naphthenyl, naphthyl, anthracyl, phenanthryl, and the various alkyl substituted compounds thereof, where alkyl is defined herein, including benzyl, tolyl, and xylyl, as well as the hydroxy substituted compounds thereof. Specific compounds in this regard include zinc cyclohexyl sulfonate, zinc phenyl sulfonate, zinc benzyl sulfonate, and the various zinc naphthalene sulfonates based on 1-naphthalene sulfonic acid, 2-naphthalene sulfonic acid, 1,5-naphthalene disulfonic acid, 1,6-naphthalene disulfonic acid, 2,6-naphthalene disulfonic acid, 2,7-naphthalene disulfonic acid, 1,3,5-naphthalene trisulfonic acid and 1,3,6-naphthalene trisulfonic acid as well as the various hydroxy naphthalene sulfonic acids including both the monosulfonic and disulfonic acids especially those described by Mosher, U.S. Pat. No. 5,427,677 which is incorporated herein by reference. Other sulfonic acids include 1-naphthol-4-sulfonic acid, 1-naphthol-5-sulfonic acid, 2-naphthol-6-sulfonic acid, 2-naphthol-7-sulfonic acid, 2-naphthol-8-sulfonic acid, naphthalene-1,5-disulfonic acid, naphthalene-1,6-disulfonic acid, naphthalene-2,5-disulfonic acid, 1-naphtol-3,6-disulfonic acid, 1-naphtol-3,8-disulfonic acid, 1-naphtol-4,8-disulfonic acid, 2-naphtol-3,6-disulfonic acid, and 2-naphtol-6,8-disulfonic acid. The invention also employs mixtures of zinc salts, based on the foregoing acids, especially the two component, three component, or four component mixtures.

Other sulfonic acids that may be employed and processes for manufacturing zinc salts of these sulfonic acids are described by Obata et al., U.S. Pat. No. 4,673,470; Dohi et al., U.S. Pat. No. 3,905,878, and U.S. Pat. No. 4,132,610; Flett, U.S. Pat. No. 2,195,409; Werntz, U.S. Pat. No. 2,187,338; Tucker, U.S. Pat. No. 2,147,415; Tinker et al., U.S. Pat. No. 2,174,507; Langedjik, U.S. Pat. No. 1,947,652; and Wilson, U.S. Pat. No. 5,039,576 all of which are incorporated herein by reference.

The invention also includes depositing alloys of zinc in lieu of the zinc coating of the present invention, and can employ organosulfonate salts of the alloying metals and zinc organosulfonates, where in formula (A), the alloying metal will be substituted for "Zn," "y" has a value of 1 up to the valence of the alloying metal, and "x" has the values given above.

Alloys of zinc may also be deposited employing alloying additives to the coating bath in lieu of or in addition to the sulfonate alloying compounds described herein. In any event, nickel alloys are the most common alloys of zinc utilized in zinc-type corrosion protection coatings and the preparation of these types of alloy coatings are also within the scope of the present invention. Any of the other Group VIII metals may be used in this regard besides nickel, and include cobalt. Zinc alloys with Cr or Mn can also be plated. Mixtures of alloying metals from Group VIII and/or Group IIB or Cr or Mn may also be prepared, especially the two component or three component alloys where the alloying metal is present in the coating in an amount anywhere from about 0.1 to about 20 percent by weight and especially from about 5 to about 15 percent by weight.

The alloys are prepared by inserting the alloy metal into the coating baths either as an anode in a manner well known in the art or by adding a salt of the alloying metal to the coating bath.

Although the examples describe the electrogalvanizing process as one that is conducted on a steel substrate, any conductive metal substrate may be employed whether a pure metal or a metal alloy, and include other iron-alloy substrates or metals or alloys based on Groups IB, IIB, IIIA, IVA, IVB, VA, VB, VIB or VIIB metals and elements, the alloys comprising combinations of two or more of these metals and elements, especially the two or three or four component combinations of metals and elements. The alloying element is present in the substrate in an amount anywhere from about 0.1 to about 20 percent by weight and especially from about 5 to about 15 percent by weight.

The various numerical ranges describing the invention as set forth throughout the specification also include any combination of the lower end of the range with the higher end of the range set forth herein including, inter alia, ranges of concentrations of compounds, ratios of these compounds to one another, molecular weights, pH, current densities, temperatures, ratios of polymer units or polymer blocks to one another, average numbers of polymer blocks in the polymer compounds of the invention, and the like, as well as all whole number and/or fractional number values and ranges encompassed within these ranges.

Throughout the specification, the inventors refer to various materials used in their invention as based on certain components, and intend that they contain substantially these components, or that these components comprise at least the base components in these materials.

It will be apparent to those skilled in the art that various modifications and variations can be made to the composition and process of the invention without departing from the spirit or scope of the invention. It is intended that these modifications and variations of this invention are to be included as part of the invention, provided they come within the scope of the appended claims and their equivalents.

We claim:

1. A process for producing semi-bright to bright electrogalvanic zinc coatings at high current densities comprising electroplating a cathodic conductive substrate in a coating bath having an anode therein, the composition of said bath consisting essentially of:

a) a zinc sulfur-acid salt;

b) a polyoxyalkylene glycol based on 2 to about 4 carbon atom alkylene oxides having a molecular weight of from about 200 to about 1,100;

c) an aromatic sulfonate; and d) a conductivity enhancing salt;

maintaining said coating composition at a pH from about 2 to about 5; and maintaining the current density on said substrate at from about 1,000 to about 3,700 ASF.

2. The process of claim 1 wherein said zinc sulfur-acid salt comprises zinc sulfate.

3. The process of claim 1 wherein said zinc sulfur-acid salt comprises a zinc organosulfonate.

4. The process of claim 1 wherein said conductivity enhancing salt comprises a potassium salt.

5. The process of one of claims 1 to 4 wherein said zinc sulfur-acid salt is present in a concentration from about 120 to about 200 gms/liter, said glycol is present in an amount from about 0.7 to about 7 gms/liter, and the weight ratio of said glycol to said aromatic sulfonate is about 2.4 to about 1.2.

6. The process of claim 5 wherein said aromatic sulfonate comprises a condensation product of an aromatic sulfonate and formaldehyde.

7. The process of claim 5 wherein the pH is maintained at from about 2.5 to about 4.5.

8. The process of claim 7 wherein the current density is from about 1,200 to 2,700 ASF.

9. The process of claim 5 wherein said anode is an insoluble anode.

10. The process of claim 5 wherein said anode is a zinc anode.

11. The process of claim 5 wherein said substrate comprises steel conduit.

12. The process of claim 5 wherein said substrate comprises steel wire.

13. The process of claim 5 wherein said substrate comprises flat steel.

* * * * *